US010747152B2

(12) United States Patent
Endo

(10) Patent No.: US 10,747,152 B2
(45) Date of Patent: Aug. 18, 2020

(54) FIXING DEVICE AND IMAGE FORMING APPARATUS

(71) Applicant: TOSHIBA TEC KABUSHIKI KAISHA, Shinagawa-ku, Tokyo (JP)

(72) Inventor: Sasuke Endo, Chigasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/517,785

(22) Filed: Jul. 22, 2019

(65) Prior Publication Data

US 2020/0183309 A1 Jun. 11, 2020

(30) Foreign Application Priority Data

Dec. 5, 2018 (JP) ..... 2018-228287

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2032; G03G 15/2053; G03G 15/2064; G03G 2215/2003; G03G 2215/2035
See application file for complete search history.

(56) References Cited

U.S. PATENT DOCUMENTS 8,005,414 B2 8/2011 Hasegawa
2016/0246227 A1* 8/2016 Ishimori ..... G03G 15/2032

* cited by examiner

*Primary Examiner* — Thomas S. Giampaolo, II
(74) *Attorney, Agent, or Firm* — Amin, Turocy & Watson, LLP

(57) ABSTRACT

A fixing device according to an embodiment includes a fixing belt, a pressurizing roller, a supporting member and a heating member. The fixing belt is supported to be capable of circularly moving and is formed endless. The pressurizing roller comes into contact with an outer circumferential surface of the fixing belt and forms a nip for holding a sheet. The supporting member is disposed on an inner side of the fixing belt and extends in an axial direction of the fixing belt. The heating member is disposed on the inner side of the fixing belt and supported by the supporting member and extends in the axial direction of the fixing belt. If the pressurizing roller does not pressurize the fixing belt, end portions of a second principal plane opposite to a first principal plane on the pressurizing roller side of the heating member are separated from the supporting member.

17 Claims, 6 Drawing Sheets

FIXING DEVICE AND IMAGE FORMING APPARATUS

CROSS-REFERENCE TO RELATED APPLICATION

This application is based upon and claims the benefit of priority from Japanese Patent Application No. 2018-228287, filed Dec. 5, 2018, the entire contents of which are incorporated herein by reference.

FIELD

Embodiments described herein relate generally to a fixing device and an image forming apparatus and methods related thereto.

BACKGROUND

A fixing device includes a fixing belt, a pressurizing roller, and a heating member. The pressurizing roller comes into press-contact with the fixing belt to form a nip. The heating member heats a sheet between the fixing belt and the pressurizing roller. The heating member includes a heating heater and a holding member that holds the heating heater.

A surface on the nip side of the heating member is sometimes formed in a curved convex shape. With this structure, the pressurizing roller presses the fixing belt in a bent state. Therefore, the pressurizing roller can equalize pressure in the nip in the axial direction of the fixing belt.

Since the surface on the nip side of the heating member is the curved convex shape, bending stress is generated if the heating member is pressed by the pressurizing roller. The bending stress decreases if the pressing by the pressurizing roller is released. Since the pressurization and the depressurization of the heating member by the pressurizing roller are repeated, the bending stress repeats an increase and a decrease. Therefore, durability of the heating member deteriorates over time.

DETAILED DESCRIPTION

An object of embodiments is to provide a fixing device and an image forming apparatus that can improve durability of a heating section.

A fixing device according to an embodiment includes a fixing belt, a pressurizing roller, a supporting member and a heating member. The fixing belt is supported to be capable of circularly moving and is formed endless. The pressurizing roller comes into contact with an outer circumferential surface of the fixing belt and forms, between the pressurizing roller and the fixing belt, a nip for holding a sheet. The supporting member is disposed on an inner side of the fixing belt and extends in an axial direction of the fixing belt. The heating member is disposed on the inner side of the fixing belt and supported by the supporting member and extends in the axial direction of the fixing belt. If the pressurizing roller does not pressurize the fixing belt, end portions of a second principal plane opposite to a first principal plane on the pressurizing roller side of the heating member are separated from the supporting member.

A fixing device and an image forming apparatus according to an embodiment are explained below with reference to the drawings.

Figure 1:
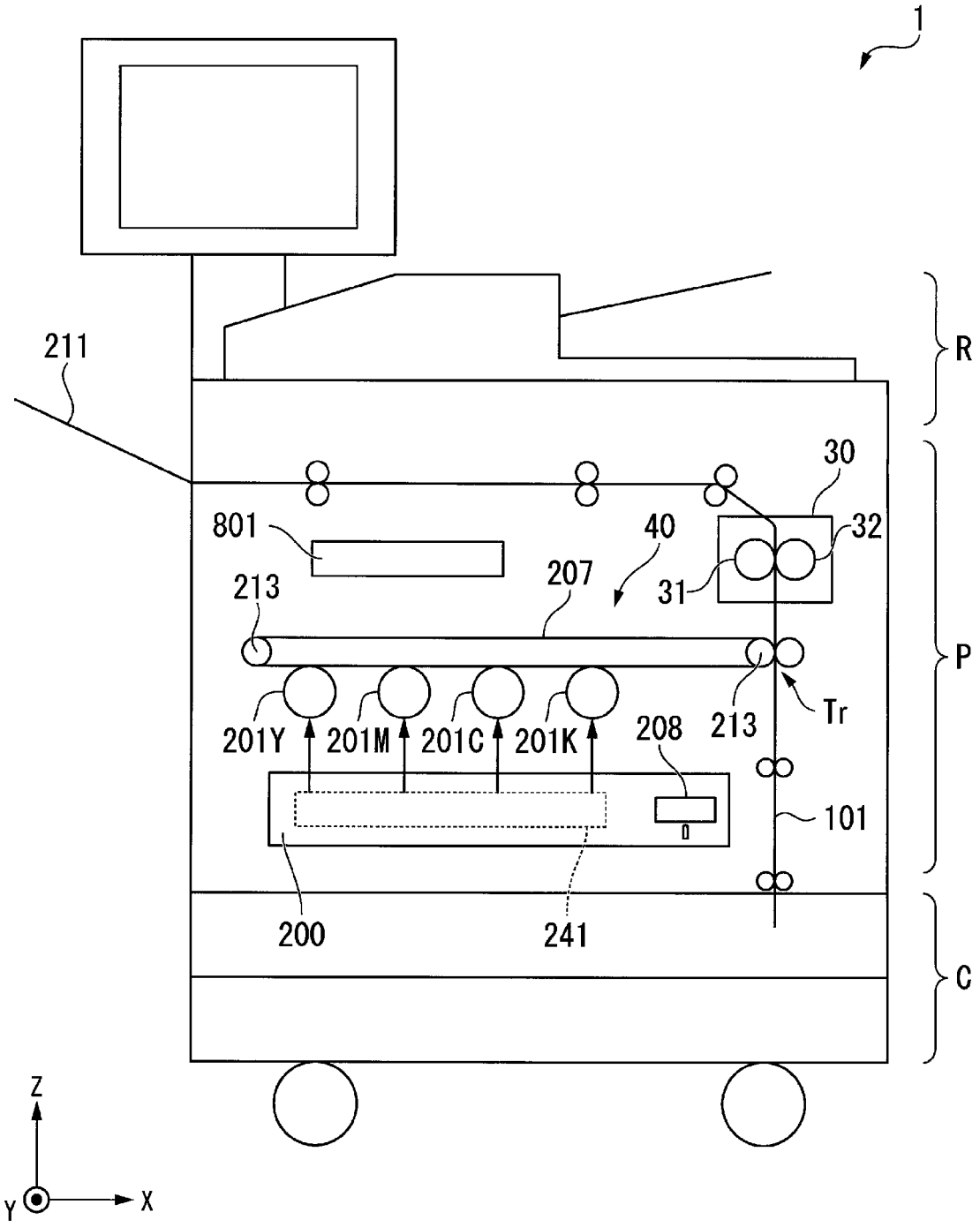
FIG. 1 is a diagram illustrating an overview of an image forming apparatus according to an embodiment.

FIG. 1 is a diagram illustrating an overview of the image forming apparatus according to the embodiment. As illustrated in FIG. 1, an image forming apparatus 1 includes a reading section R, an image forming section P, and a paper feeding cassette section C. In the following illustration and explanation, an XYZ coordinate system is used according to necessity. An X direction is the horizontal direction. The X direction is the lateral width direction of the image forming apparatus 1. A Y direction is a direction orthogonal to the X direction in the horizontal plane. The Y direction is the front-rear direction of the image forming apparatus 1. A Z direction is a direction orthogonal to the X direction and the Y direction. The Z direction is the height direction of the image forming apparatus 1.

The reading section R reads, with a CCD (Charge-Coupled Device) image sensor or the like, a document sheet set on a document table and generates an optical signal. The reading section R converts the generated optical signal into digital data. The image forming section P acquires a document image read by the reading section R or printing data transmitted from an external personal computer. The image forming section P forms, on a sheet, a toner image based on the acquired document image or printing data. The image forming section P fixes the toner image formed on the sheet.

The image forming section P includes a laser scanning section 200 and photoconductive drums 201Y, 201M, 201C, and 201K. The laser scanning section 200 includes a polygon mirror 208 and an optical system 241. The laser scanning section 200 irradiates, on the photoconductive drums 201Y to 201K, images to be formed on a sheet. The images on the sheet are images based on image signals of colors of yellow (Y), magenta (M), cyan (C), and black (K).

The photoconductive drums 201Y to 201K retain, according to irradiation positions on the sheet, color toner images supplied from a not-illustrated developing device. The photoconductive drums 201Y to 201K sequentially transfer the retained toner images onto a transfer belt 207. The transfer belt 207 is an endless belt. A roller 213 is driven to rotate, whereby the transfer belt 207 conveys the toner images to a transfer position T.

A conveyance path 101 connects the paper feeding cassette section C, the transfer position Tr, a fixing device 30, and a discharge tray 211. A sheet stored in the paper feeding cassette section C is conveyed to the transfer position T along the conveyance path 101. In the transfer position T, the transfer belt 207 transfers the toner images onto the sheet.

The sheet, onto which the toner images are transferred, is conveyed to the fixing device 30 along the conveyance path 101. The fixing device 30 heats and melts the toner images to cause the toner image to permeate the sheet and fix the toner image. Consequently, the toner images on the sheet are prevented from being disturbed by an external force. The sheet, on which the toner images are fixed, is conveyed to the discharge tray 211 along the conveyance path 101. The conveyed sheet is discharged to the outside of the image forming apparatus 1 from the discharge tray 211.

A control section 801 is a unit that collectively controls devices and mechanisms in the image forming apparatus 1. The control section 801 includes a central arithmetic unit such as a CPU (Central Processing Unit) and volatile and nonvolatile storage devices. The central arithmetic unit executes an arithmetic operation of computer programs stored in the storage devices, whereby the control section 801 controls the devices and the mechanisms in the image forming apparatus 1. A part of functions may be implemented as a circuit.

A component including units for conveyance of a formation target image (toner image) to the transfer position Tr to transfer of the formation target image onto the sheet is a transfer section 40.

The fixing device 30 is explained in detail. The fixing device 30 is a fixing section of a so-called direct heat type.

Figure 2:
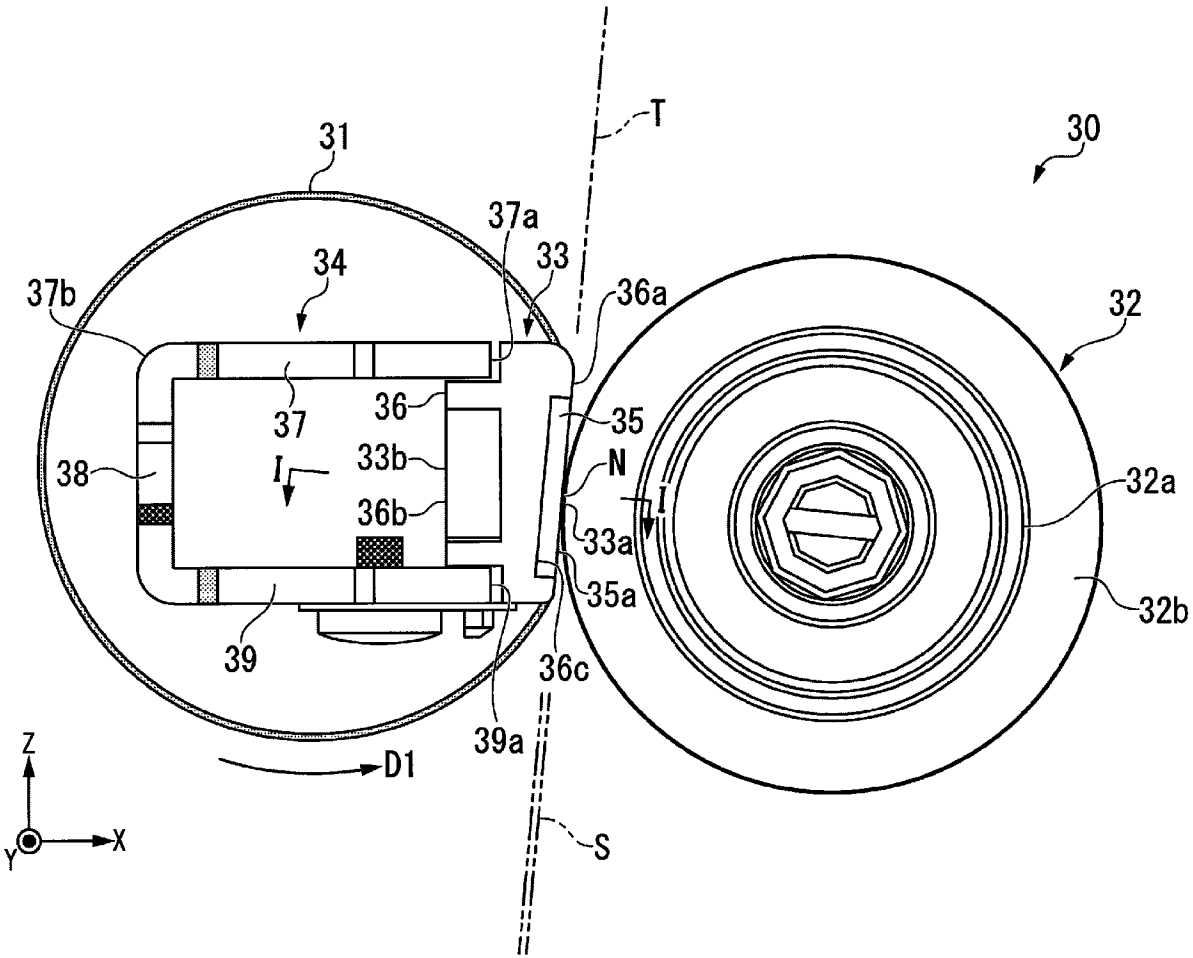
FIG. 2 is a front view of a fixing device according to the embodiment.
Figure 5:
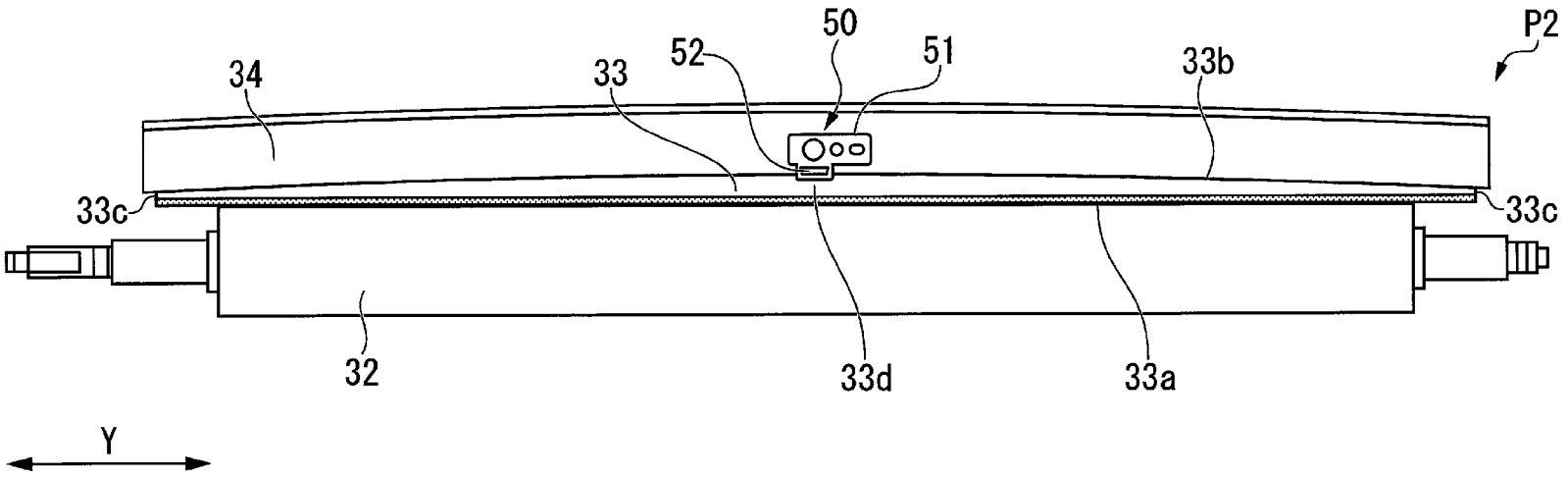
FIG. 5 is a configuration diagram of the fixing device during pressurization.

FIG. 2 is a front view of the fixing device 30 in a pressurizing form P2 (see FIG. 5). The axial direction of a fixing belt 31 is sometimes simply referred to as "axial direction".

As illustrated in FIG. 2, the fixing device 30 includes the fixing belt (a belt) 31, a pressurizing roller (a roller) 32, a heating member 33, and a supporting member 34. In FIG. 2, "T" indicates a tangential line in a fixing nip N between the fixing belt 31 and the pressurizing roller 32. The tangential line T is orthogonal to the axial direction (a Y direction).

The fixing belt 31 is formed of a flexible material in a tubular shape. The fixing belt 31 is an endless belt-like (film-like) member. Although not illustrated in FIG. 2, the fixing belt 31 includes a base layer, an elastic layer, and a surface release layer. The base layer is configured by a sheet-like member having high heat resistance. The base layer is made of a metal material such as nickel or stainless steel, a resin material such as polyimide (PI), or the like. Surface coating may be applied to the inner surface of the base layer in order to improve frictional slidability with respect to the heating member 33. The elastic layer is made of an elastic material such as silicone rubber. The surface release layer is made of tetrafluoroethylene-perfluoro alkylvinyl ether copolymer (PFA), polytetrafluoroethylene (PTFE), or the like. In order to prevent a warming-up time from being increased, the thicknesses of the elastic layer and the surface release layer are selected such that a heat capacity is not excessively large.

The fixing belt 31 is capable of circularly moving around the axis of the fixing belt 31 in a state in which the fixing belt 31 is supported by a not-illustrated supporting mechanism.

The pressurizing roller 32 is disposed side by side with the fixing belt 31. The pressurizing roller 32 includes a core member 32*a* and an elastic layer 32*b*. The core member 32*a* is formed of metal or the like in a cylindrical shape. Both end portions of the core member 32*a* are supported by supporting bodies (not illustrated in FIG. 2) in the fixing device 30 via bearings (not illustrated in FIG. 2). The core member 32*a* is capable of rotating around the axis of the core member 32*a*. The elastic layer 32*b* is provided on the outer circumferential surface of the core member 32*a*. The elastic layer 32*b* is formed of foaming silicone rubber, silicone rubber, fluorocarbon rubber, or the like. A release layer (not illustrated in FIG. 2) may be formed on the outer circumferential surface of the elastic layer 32*b*. PFA, PTFE, or the like is used as the release layer.

The pressurizing roller 32 is pressurized to the fixing belt 31 side by not-illustrated pressurizing means and comes into contact with the outer circumferential surface of the fixing belt 31. In a portion where the pressurizing roller 32 and the fixing belt 31 come into press-contact, the elastic layer 32*b* of the pressurizing roller 32 is elastically compressed, whereby the fixing nip (a nip) N having a predetermined width in a conveying direction of a sheet S is formed. In the fixing nip N, the pressurizing roller 32 holds the sheet S between the pressurizing roller 32 and the fixing belt 31.

The pressurizing roller 32 is driven to rotate by a driving source (not illustrated in FIG. 2) such as a motor. For example, the pressurizing roller 32 can be driven to rotate by a driving mechanism including the driving source and a gear train (not illustrated in FIG. 2). If the pressurizing roller 32 is driven to rotate, a driving force of the pressurizing roller 32 is transmitted to the fixing belt 31 in the fixing nip N. The fixing belt 31 rotates following the rotation of the pressurizing roller 32. In conveying the sheet S, the fixing belt 31 rotates in a first direction (a delivering direction) D1 of the circumferential direction of the fixing belt 31.

The pressurizing roller 32 can switch, with a not-illustrated switching mechanism, a depressurizing form P1 (explained below) and the pressurizing form P2 (explained below). The pressurizing roller 32 switches the fixing device 30 to the depressurizing form P1 if not being driven and switches the fixing device 30 to the pressurizing form P2 only if being driven to rotate. Consequently, it is possible to suppress a creep of the fixing belt 31 and the pressurizing roller 32.

A surface of the pressurizing roller 32 opposed to the fixing nip N is formed in a straight shape (a linear shape) extending along the axial direction (the Y direction) (see FIG. 4) when viewed from a direction parallel to the tangential line T (see FIG. 2).

The heating member 33 includes a heating heater 35 and a holding member 36. The heating member 33 is disposed on the inner side of the fixing belt 31. The heating member 33 is formed in a long plate shape extending along the axial direction (the Y direction). The heating member 33 is generally disposed with the thickness direction of the heating member 33 directed to the pressurizing roller 32. A direction in which the heating member 33 approaches the pressurizing roller 32 is referred to as front. A direction in which the heating member 33 separates from the pressurizing roller 32 is referred to as rear. A front surface 33*a* (a first principal plane) of the heating member 33 is a surface in contact with the fixing belt 31. The front surface 33*a* is a surface on the fixing nip N side. A rear surface 33*b* (a second principal plane) is a surface opposite to the front surface 33*a*. The rear surface 33*b* is a surface opposite to the fixing nip N side.

The heating heater 35 is provided in a holding recessed section 36*c* of the holding member 36. A front surface 35*a* of the heating heater 35 configures a part of the front surface 33*a* of the heating member 33. The heating heater 35 includes a resistance film (not illustrated in FIG. 2), a substrate (not illustrated in FIG. 2), and a protection layer (not illustrated in FIG. 2). The resistance film is laminated on the substrate. The resistance film generates heat with energization. The resistance film may be divided into a plurality of resistance films in the axial direction (the Y direction). The divided plurality of resistance films desirably can be independently energized. Consequently, temperatures can be independently decided concerning the plurality of resistance films. Therefore, only a region where the sheet S passes can be heated. The substrate is made of ceramic, stainless steel, or the like. The protection layer is provided on the surfaces of the resistance film and the substrate. For example, the protection layer is made of $SiO_2$. The heating heater 35 is generally disposed with the thickness direction of the heating heater 35 directed to the pressurizing roller 32.

The holding recessed section 36*c*, in which the heating heater 35 is provided, is formed on a front surface 36*a* of the holding member 36. The holding recessed section 36*c* is formed in a groove shape extending along the axial direction (the Y direction). The holding member 36 holds the heating heater 35.

The holding member 36 extends in the axial direction (the Y direction). The holding member 36 is formed in a long plate shape extending along the axial direction (the Y direction). The holding member 36 is made of an elastic material such as silicone rubber or fluoro rubber, heat resistant resin such as polyimide resin, polyphenylene sulfide (PPS), polyether sulfone (PES), or liquid crystal polymer (LCP), or the like.

A not-illustrated high heat conduction member may be disposed between the holding recessed section 36*c* and the heating heater 35. For example, the high heat conduction member is formed in a sheet shape. The high heat conduction member has high thermal conductivity compared with the holding recessed section 36*c* and the heating heater 35. For example, the high heat conduction member is made of metal having high thermal conductivity such as copper or aluminum. A graphite sheet may be used as the high heat conduction member. The high heat conduction member has an effect of reducing a temperature gradient in the longitudinal direction of the fixing belt 31 and the heating heater 35 and preventing a local temperature rise.

Figure 3:
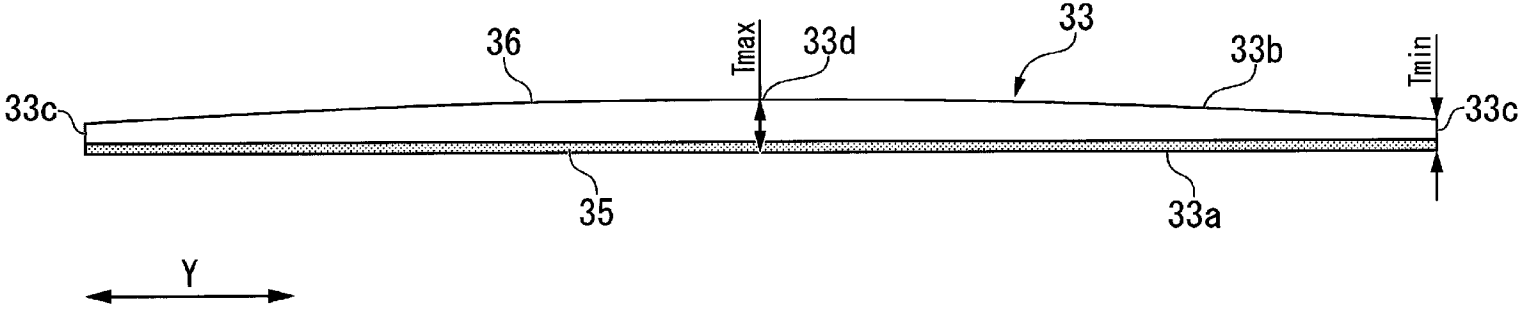
FIG. 3 is a sectional view of a heating member of the fixing device.

FIG. 3 is a sectional view of the heating member 33. FIG. 3 is a diagram illustrating a cross section (a I-I cross section illustrated in FIG. 2) orthogonal to the tangential line T (see FIG. 2) in the fixing nip N.

As illustrated in FIG. 3, the front surface 33*a* of the heating member 33 is formed in a straight shape (a linear shape) extending along the axial direction (the Y direction) at the position of the fixing nip N when viewed from the direction parallel to the tangential line T. The rear surface 33*b* (a surface opposite to the fixing nip N side) of the heating member 33 is formed in a curved convex shape when viewed from the direction parallel to the tangential line T. For example, the curved convex shape may be an arcuate shape or may be a higher-order curve shape (e.g., a quadratic curve shape) such as an elliptical arc shape, a parabolic shape, and a hyperbolic shape. Since the cross section of the front surface 33*a* is the straight shape and the cross section of the rear surface 33*b* is the curved convex shape, a center portion 33*d* of the heating member 33 is formed thick compared with end portions 33*c* in the axial direction (the Y direction) of the heating member 33.

In detail, the bottom surface of the holding recessed section 36*c* of the holding member 36 is formed in a straight shape extending along the axial direction (the Y direction). A rear surface 36*b* (the rear surface 33*b*) of the holding member 36 is formed in a curved convex shape. Consequently, a center portion 36*e* of the holding member 36 is formed thick compared with end portions 36*d* in the axial direction (the Y direction) of the holding member 36. The thickness of the heating heater 35 is fixed in the axial direction (the Y direction).

The heating member 33 illustrated in FIG. 3 is the thinnest at the end portions 33*c*. The thickness of the heating member 33 at the end portions 33*c* is represented as Tmin. For example, the thicknesses of both the end portions 33*c* of the heating member 33 are equal to each other. The heating member 33 is the thickest in the center portion 33*d*. The thickness of the heating member 33 in the center portion 33*d* is represented as Tmax.

As illustrated in FIG. 2, the supporting member 34 supports the holding member 36. The supporting member 34 includes an upper holding plate 37, a coupling member 38, and a lower holding plate 39. For example, the upper holding plate 37 extends along an XY plane. At least a part in the axial direction (the Y direction) of a front end portion 37*a* of the upper holding plate 37 reaches an upper part of the holding member 36. The coupling member 38 extends downward from a rear end portion 37*b* of the upper holding plate 37. The lower holding plate 39 extends from the lower end portion of the coupling member 38 in a direction in which the lower holding plate 39 approaches the holding member 36. The lower holding plate 39 is parallel to the upper holding plate 37. At least a part in the axial direction (the Y direction) of a front end portion 39*a* of the lower holding plate 39 reaches a lower part of the holding member 36.

Figure 4:
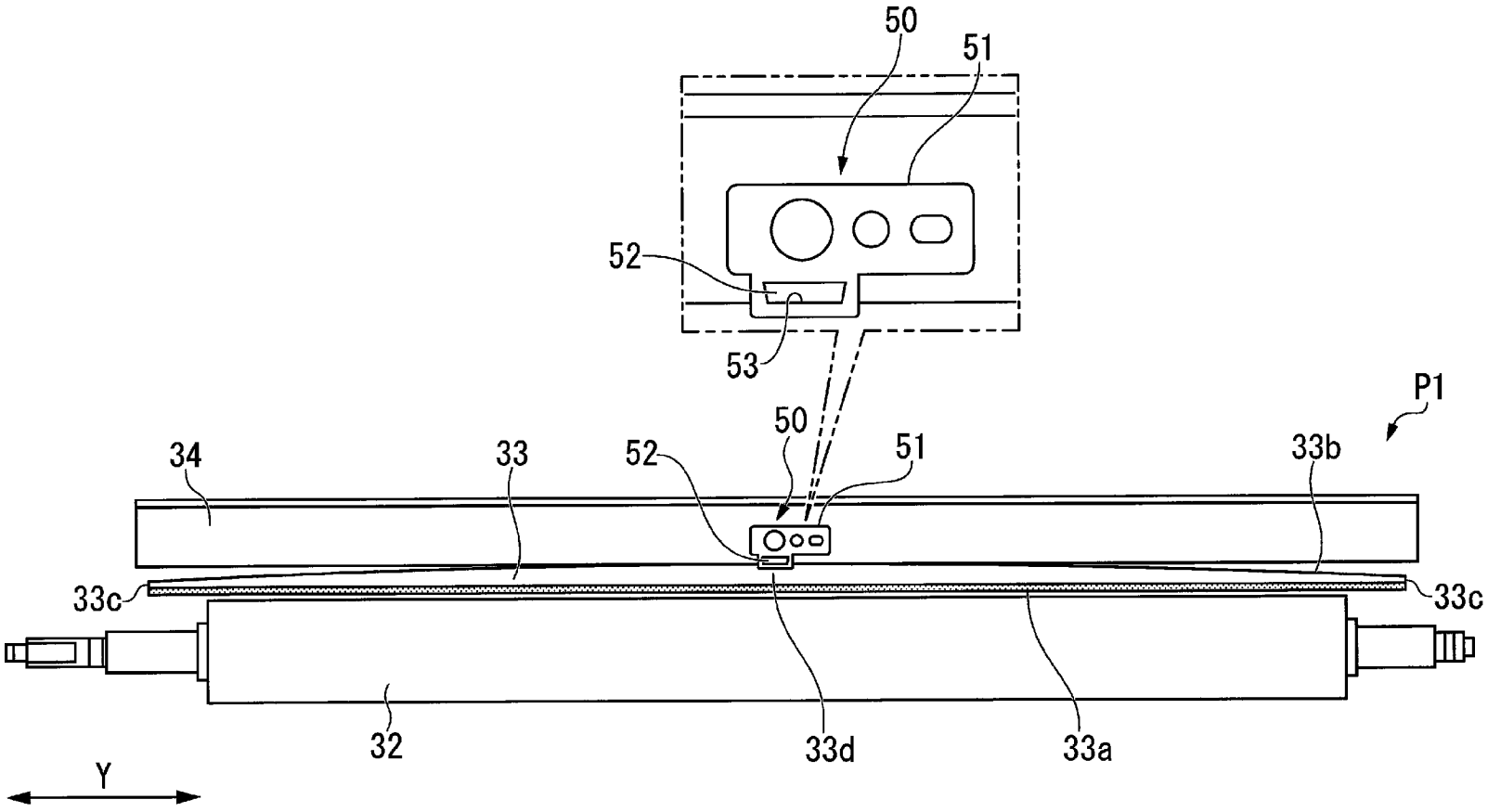
FIG. 4 is a configuration diagram of the fixing device during depressurization.

FIG. 4 is a configuration diagram of the fixing device 30 at the time when the pressurizing roller 32 does not pressurize the fixing belt 31. FIG. 4 is a diagram of the fixing device 30 viewed from the direction parallel to the tangential line T (see FIG. 2).

As illustrated in FIG. 4, a form of the fixing device 30 at the time when the pressurizing roller 32 does not press the fixing belt 31 is referred to as "depressurizing form P1". In the depressurizing form P1, a range including the center portion 33*d* in the rear surface 33*b* of the heating member 33 is in contact with the supporting member 34. Since the rear surface 33*b* of the heating member 33 has a curved convex shape, portions including the end portions 33*c* in the rear surface 33*b* of the heating member 33 are separated from the supporting member 34.

The heating member 33 can be positioned with respect to the supporting member 34 using a positioning mechanism 50. The positioning mechanism 50 includes a positioning member 51 and a locking claw 52. The positioning member 51 includes a locking hole 53 in which the locking claw 52 is locked. The positioning member 51 is provided in the center in the axial direction (the Y direction) of the supporting member 34 (e.g., the upper holding plate 37 and the lower holding plate 39). The locking claw 52 is provided in the center in the axial direction (the Y direction) of the heating member 33. The locking claw 52 is locked in the locking hole 53 of the positioning member 51, whereby the heating member 33 is positioned with respect to the supporting member 34.

The heating member 33 is positioned with respect to the supporting member 34 in the center of the axial direction (the Y direction) by the positioning mechanism 50. Therefore, the heating member 33 can be positioned without being affected by displacement due to a bend of the supporting member 34.

The thickness Tmin and the thickness Tmax of the heating member 33 are designed according to a bend amount of the supporting member 34 at the time when the fixing belt 31 is pressurized by the pressurizing roller 32. For example, if a maximum gap between the heating member 33 and the supporting member 34 is represented as "G", the thickness Tmin and the thickness Tmax are set such that the following Expression (1) holds. For example, the maximum gap G is a gap between the end portions 33*c* of the heating member 33 and the supporting member 34.

$$G \geq T\max - T\min \quad (1)$$

If Expression (1) holds, the front surface 33*a* of the heating member 33 can be kept in the straight shape. Therefore, it is possible to prevent unnecessary stress from being applied to the heating member 33.

FIG. 5 is a configuration diagram of the fixing device 30 at the time when the pressurizing roller 32 pressurizes the fixing belt 31. FIG. 5 is a diagram of the fixing device 30 viewed from the direction parallel to the tangential line T (see FIG. 2).

As illustrated in FIG. 5, a form of the fixing device 30 at the time when the pressurizing roller 32 pressurizes the fixing belt 31 is referred to as "pressurizing form P2". In the pressurizing form P2, the pressurizing roller 32 presses the supporting member 34 via the heating member 33. The rear surface 33*b* formed in the curved convex shape of the heating member 33 presses a range including the center portion of the supporting member 34. Therefore, a range including the center in the axial direction (the Y direction) of the supporting member 34 is pressed backward. The supporting member 34 is formed in a curved shape that is convex backward.

The distance between the end portions 33*c* of the heating member 33 and the supporting member 34 in the pressurizing form P2 is smaller than the distance between the end portions 33*c* of the heating member 33 and the supporting member 34 in the depressurizing form P1. If a pressing force by the heating member 33 is sufficiently high, the supporting member 34 is in contact with the rear surface 33*b* of the heating member 33 over the entire length in the axial direction (the Y direction) of the supporting member 34.

As illustrated in FIG. 4, if the pressing by the pressurizing roller 32 is released, the fixing device 30 shifts to the depressurizing form P1.

Both of the surface of the pressurizing roller 32 opposed to the fixing nip N and the front surface 33*a* of the heating member 33 have the straight shapes. Therefore, the pressing force applied to the heating member 33 by the pressurizing roller 32 is equal in the axial direction (the Y direction). Therefore, if the fixing device 30 shifts from the depressurizing form P1 to the pressurizing form P2, a bending stress generated in the heating member 33 is small. Accordingly, bending deformation of the heating member 33 is small.

Figure 6:
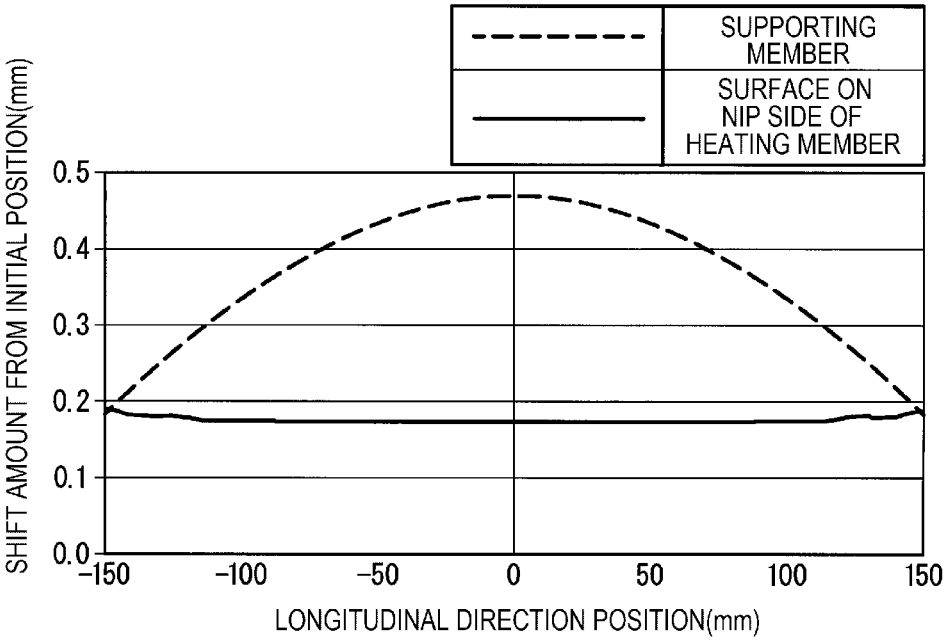
FIG. 6 is a diagram illustrating deformation amounts of the heating member and a supporting member.

FIG. 6 is a diagram illustrating deformation amounts of the heating member 33 and the supporting member 34. As illustrated in FIG. 6, if the fixing device 30 shifts from the depressurizing form P1 to the pressurizing form P2, a shift amount of the front surface 33*a* of the heating member 33 (the surface on the nip side of the heating member) is substantially fixed in the axial direction (the Y direction). On the other hand, a shift amount of the supporting member 34 is large in the center portion and small at the end portions.

In the fixing device 30, since the bending stress generated in the heating member 33 in the pressurizing form P2 is small, even if the depressurizing form P1 and the pressurizing form P2 are repeated, it is possible to improve durability of the heating member 33.

In the fixing device 30, since the front surface 33*a* of the heating member 33 has the straight shape, bending of the heating heater 35 is unnecessary. Accordingly, the fixing device 30 is excellent in manufacturability.

The thickest part in the axial direction of the heating member is not limited to the center portion and may be parts closer to the end portions than the center portion.

The front surface 33*a* of the heating member 33 in the embodiment has the straight shape and the rear surface 33*b* of the heating member 33 has the curved convex shape. However, the shape of the heating member is not limited to this shape. For example, the front surface of the heating member may have a curved convex shape.

According to at least one embodiment explained above, since bending stress generated in the heating member if pressurized by the pressurizing roller is small, it is possible to improve durability of the heating member.

The several embodiments are explained above. However, the embodiments are presented as examples and are not intended to limit the scope of the invention. These new embodiments can be implemented in other various forms. Various omissions, substitutions, and changes can be made without departing from the spirit of the invention. These embodiments and modifications of the embodiments are included in the scope and the gist of the invention and included in the inventions described in claims and the scope of equivalents of the inventions.

What is claimed is:

1. A fixing device, comprising:

an endless fixing belt configured to circularly move;

a pressurizing roller configured to contact an outer circumferential surface of the fixing belt and form, between the pressurizing roller and the fixing belt, a nip for holding a sheet;

a supporting member disposed on an inner side of the fixing belt and extending in an axial direction of the fixing belt; and a heater having a first surface facing the pressurizing roller and a second surface opposite to the first surface, disposed on the inner side of the fixing belt and supported by the supporting member and extending in the axial direction of the fixing belt, configured so that when the pressurizing roller does not pressurize the fixing belt, end portions of the second surface are separated from the supporting member, wherein a first principal plane of the heater has a linear shape extending along the axial direction when viewed from a direction parallel to a tangential line in the nip, and wherein a second principal plane of the heater has a curved convex shape when viewed from the direction parallel to the tangential line in the nip.

2. The device according to claim 1, wherein the pressurizing roller is further configured to switch between a depressurizing form for not pressurizing the fixing belt and a pressurizing form for pressurizing the fixing belt, and a distance between end portions of the heating member and the supporting member in the pressurizing state is smaller than a distance between the end portions of the heating member and the supporting member in the depressurizing state.

3. The device according to claim 2, wherein the pressurizing roller is in the depressurizing form when not driven and in the pressurizing form when driven.

4. The device according to claim 1, wherein, when a maximum thickness of the heating member is represented as Tmax, a minimum thickness of the heating member is represented as Tmin, and a maximum gap between the heating member and the supporting member is represented as G, following Expression (1) holds:

$$G \geq T\max - T\min \quad (1)$$

5. The device according to claim 1, wherein the heating member is positioned with respect to the supporting member by a positioning mechanism provided in a center in the axial direction.

6. The device according to claim 1, wherein the pressurizing roller comprises an elastic layer, and the elastic layer is compressed when the pressurizing roller contacts the outer circumferential surface of the fixing belt.

7. The device according to claim 1, wherein the heating member comprises a resistance film.

8. The device according to claim 7, wherein the resistance film comprises a plurality of resistance films in the axial direction.

9. The device according to claim 1, wherein the heating member has a middle portion and two end portions in the axial direction, and an uneven thickness in the axial direction.

10. The device according to claim 9, wherein a thickness of the middle portion is greater than a thickness of each of the two end portions.

11. A fixing method, comprising:

contacting an outer circumferential surface of an endless fixing belt with a pressurizing roller to form, between the pressurizing roller and the fixing belt, a nip for holding a sheet; and when the pressurizing roller does not pressurize the fixing belt, separating end portions of a second principal plane having a curved convex shape when viewed from a direction parallel to a tangential line in the nip opposite to a first principal plane having a linear shape extending along the axial direction when viewed from the direction parallel to the tangential line in the nip on a pressurizing roller side of a heating member from a supporting member, the supporting member disposed on an inner side of the fixing belt and extending in an axial direction of the fixing belt, the heating member disposed on the inner side of the fixing belt and supported by the supporting member and extending in the axial direction of the fixing belt.

12. The method according to claim 11, further comprising:

switching the pressurizing roller between a depressurizing form for not pressurizing the fixing belt and a pressurizing form for pressurizing the fixing belt, wherein a distance between end portions of the heating member and the supporting member in the pressurizing state is smaller than a distance between the end portions of the heating member and the supporting member in the depressurizing state.

13. The method according to claim 12, further comprising:

not driving the pressurizing roller to obtain the depressurizing form and driving the pressurizing roller to obtain the pressurizing form.

14. The method according to claim 12, wherein, when a maximum thickness of the heating member is represented as Tmax, a minimum thickness of the heating member is represented as Tmin, and a maximum gap between the heating member and the supporting member is represented as G, following Expression (1) holds:

$$G \geq Tmax - Tmin \quad (1)$$

15. An image forming apparatus, comprising:

a conveyance mechanism;

a reader;

a control section; and an image forming section comprising a fixing device, comprising:

an endless fixing belt configured to circularly move;

a pressurizing roller configured to contact an outer circumferential surface of the fixing belt and form, between the pressurizing roller and the fixing belt, a nip for holding a sheet;

a supporting member disposed on an inner side of the fixing belt and extending in an axial direction of the fixing belt; and a heating member disposed on the inner side of the fixing belt and supported by the supporting member and extending in the axial direction of the fixing belt, configured so that when the pressurizing roller does not pressurize the fixing belt, end portions of a second principal plane opposite to a first principal plane on the pressurizing roller side of the heating member are separated from the supporting member, wherein the first principal plane of the heating member has a linear shape extending along the axial direction when viewed from a direction parallel to a tangential line in the nip, and wherein the second principal plane of the heating member has a curved convex shape when viewed from the direction parallel to the tangential line in the nip.

16. The apparatus according to claim 15, wherein the pressurizing roller is further configured to switch between a depressurizing form for not pressurizing the fixing belt and a pressurizing form for pressurizing the fixing belt, and a distance between end portions of the heating member and the supporting member in the pressurizing state is smaller than a distance between the end portions of the heating member and the supporting member in the depressurizing state.

17. The apparatus according to claim 15, wherein, when a maximum thickness of the heating member is represented as Tmax, a minimum thickness of the heating member is represented as Tmin, and a maximum gap between the heating member and the supporting member is represented as G, following Expression (1) holds:

$$G \geq Tmax - Tmin \quad (1).$$

* * * * *